United States Patent [19]

Golding et al.

[11] Patent Number: 4,784,095

[45] Date of Patent: Nov. 15, 1988

[54] ROCKER ARM ADJUSTING NUT

[75] Inventors: Michael J. Golding, Port Orange; William A. Pohle, Daytona Beach, both of Fla.

[73] Assignee: Crane Cams, Incorporated, Daytona Beach, Fla.

[21] Appl. No.: 133,466

[22] Filed: Dec. 15, 1987

[51] Int. Cl.[4] ..... F01L 1/18; F01M 9/10

[52] U.S. Cl. ..... 123/90.41; 123/90.33

[58] Field of Search ..... 123/90.33, 90.36, 90.39, 123/90.41, 90.42

[56] References Cited

U.S. PATENT DOCUMENTS

| | | | |
|---|---|---|---|
| 1,469,155 | 4/1923 | Hedburg | 123/90.33 |
| 1,659,528 | 2/1928 | Hosterman | 123/90.33 |
| 2,288,831 | 7/1942 | O'Harrow | 123/90.39 |
| 2,976,862 | 3/1961 | Allen | 123/90.33 X |
| 3,064,635 | 11/1962 | Rohrbacher | 123/90.41 |
| 3,195,527 | 7/1965 | Eaton | 123/90.42 |
| 3,251,350 | 5/1966 | Thompson | 123/90.41 |
| 3,289,657 | 12/1966 | Winter, Jr. | 123/90.33 |
| 3,592,174 | 7/1971 | Heidacker | 123/90.42 X |
| 3,875,908 | 4/1975 | Ayres | 123/90.36 |
| 4,440,121 | 4/1984 | Clancy | 123/90.39 |
| 4,537,166 | 8/1985 | Kimura et al. | 123/90.36 |
| 4,655,176 | 4/1987 | Sheehan | 123/90.16 |

*Primary Examiner*—Willis R. Wolfe

*Attorney, Agent, or Firm*—Warren E. Olsen

[57] ABSTRACT

An improved rocker arm adjusting nut characterized by an upper collar, a lower flange and an axially elongated body with a substantially cylindrical central section that is provided with knurling, or grooves in the axial direction. The upper collar and knurling deflect oil axially towards the lower flange when used according to its intended purpose with a stamped steel rocker arm, of conventional design. The enlarged mass and surface area of the adjusting nut helps both to dissipate temperature from the pivot ball-rocker arm interface, by conduction, and deflect oil towards the pivot ball-rocker arm interface.

6 Claims, 2 Drawing Sheets

ROCKER ARM ADJUSTING NUT

BACKGROUND OF THE INVENTION

1. Field of the Invention:

An improved rocker arm adjusting nut particularly suited for use with steel rocker arms, in automotive engines, in order to achieve an improved cooling and feed oil flow to the pivot ball-rocker arm interface.

2. Brief Description of the Prior Art:

Rocker arms commonly are used in an overhead valve, internal combustion engine to translate linear motion from a push rod to linear actuation of a poppet valve. Typically, such rocker arms are stamped steel, and are maintained in place by a rocker arm adjusting nut, whereby a frictional movement occurs between a pivot ball and an inner rocker arm surface. Representative prior art rocker arm and adjusting nut designs are shown by the prior U.S. patents, as follows:

HEDBERG: 1,469,155
O'HARROW: 2,288,831
THOMPSON: 3,251,350
AYRES: 3,875,908
CLANCY: 4,440,121
KIMURA et al.: 4,537,166
SHEEHAN: 4,655,176

In summary, these prior art references illustrate a variety of techniques for lubricating rocker arms and overhead valve internal combustion engines. For example, AYRES illustrates an oil deflector mounted on the pivoted end of a rocker arm, so as to direct oil being discharged from cam lobes into an aperture, of the rocker arm. In contrast, the present invention essentially involves improvement by an oil deflecting shoulder at the top of an extended rocker arm adjusting nut, wherein this shoulder and associated structure of the nut enhances lubrication of the rocker arm-pivot ball interface by redirecting oil downward, towards a fulcrum at that interface. The improved rocker arm adjusting nut herein also has a significantly increased mass, in order to function as a heat sink. An axially extended middle portion also defines a large, vertical surface that is channeled to direct oil downward to the pivot ball-rocker arm interface, for the purpose of improving lubrication and cooling at that critical zone.

The HEDBERG and O'HARROW rocker arms are of the shaft-mounted types and are noted simply for discussions of how oil is necessary to lubricate a bearing surface.

THOMPSON illustrates a rocker arm shaft mounting assembly wherein lands (34 FIG. 5) extend from a horizontally disposed shaft, in order to urge lubricant towards the needle bearing supporting the rocker arm on that shaft.

AYRES illustrates a cam-over-rocker type of valve gear arrangement for an internal combustion engine in which an oil deflector, 26, (FIG. 1) is mounted at the end of a rocker arm, so that oil discharged from a cam wil be deflected into an aperture of the rocker arm.

CLANCY et al. illustrate a nut lock device for an engine rocker arm adjustment, and shows a conventional rocker arm by oil ejected through lubricating passage 54. Oil pressurized by a hydraulic valve like 15 is sent through a hollow push rod, 24, and out operature 2421.

KIMURA et al. demonstrates another rocker arm shaft assembly with bolts that have annular flanges (34, 35 in FIG. 6) and enlarged portions to fit tightly against a seating member, to prevent leakage of oil from the hollow interior of a rocker shaft.

SHEEHAN shows a high-performance, shaft-mounted rocker arm of the solid aluminum variety, that categorically is not subject to the lubrication and cooling failures of conventional, stamped steel rocker arms mounted on pivot balls, as found in many production engines manufactured in the United States.

The present invention is distinguished from such prior art by a rocker arm adjusting nut, with a locking screw, that is capable of use with stamped steel rockers and rocker adjusting ball pivots to improve lubrication and heat dissipation without further modification of the rocker arm or the pivot ball. The present invention not only directs engine oil to lubricate the highly stressed pivot ball-rocker arm interface, but the nut also reduces heat build-up by conducting heat away from that same critical area.

Accordingly, a first object of the present invention is to provide a rocker arm adjusting nut that will catch and redirect lubricating oil droplets in a controlled fashion to the pivot ball-rocker arm interface, to enhance lubrication of that high friction area.

A second objection of the present invention is to provide a rocker arm adjusting nut that is capable of interacting with a rocker arm of the conventional stamped steel variety, without requiring any modification of the rocker arm or any associated valve train element.

A third object of the present invention is to define an improved rocker arm adjusting nut that will enhance heat transfer away from the pivot ball-rocker arm interface so as to prevent burning of pivot balls and to increase rocker arm life.

The present invention is characterized by an overall novel cooperation of structure that achieves each of the above-described objects. Simple replacement of the rocker arm adjustment nut has been found to achieve longer life for a stamped steel rocker arm, by eliminating the common problems of oil starvation to the pivot ball and burning of the pivot ball due to localized high temperatures.

BRIEF SUMMARY OF THE INVENTION

The present invention essentially comprises an axially elongated rocker arm adjusting nut, having an upper collar diameter substantially equal to the transverse upper opening of conventional stamped steel rocker arms; a central knurled body portion of slightly lesser diameter; and a bottom flange of a diameter substantially equal to the upper collar diameter. The upper collar and part of the knurled portion extend well-above, but do not interfere with, a large category of existing steel rocker arms. Accordingly, the improved nut presents a deflection structure for lubricating oil droplets ejected through a hollow push rod, that otherwise would never be directed to the pivot ball-rocker arm interface.

The rocker arm adjusting nut has a bottom flange dimension that likewise maximized to fit within the constraints of a large number of conventional, stamped steel rocker arms. The large dimension bottom flange also is mazimized to increase the cross-sectional area of a heat transfer away from the top of the pivot ball, so that full advantage may be had from the thermal capacity of the rocker arm adjusting nut. The adjusting nut is both a heat sink and a radiating heat exchanger element with respect to heat conducted away from the pivot ball-rocker arm interface.

Between the upper collar and the bottom flange, the present invention is characterized by vertical knurling, upon a substantially right circular cylinder surface having a diameter approximately ⅛ inch less than the diameter of the upper collar. The large, knurled surface area is exposed both to ambient air and oil droplet impingement. It has been found that another advantage of the elongated and enlarged diameter adjusting nut is that the strength of the nut is increased. Further, the large diameter central body section reduces machining time required in its manufacture.

An improved rocker arm adjusting nut according to the present invention is characterized by an axially elongated right circular configuration that is significantly more massive than conventional rocker arm adjusting nuts. The upper collar overhangs, to direct upwardly traveling oil sprays downward onto a knurled central body section. The vertical knurling prevents impinging oil from traveling transversely around the circumference of the nut central body, and directs oil axially downward towards a region directly below the rocker arm adjusting nut. The axial elongation of the knurled section, and the upper collar, ensures that high oil pressures will not cause oil to overshoot the entire nut. Oil impinging against the lower surface of the upper collar can travel circumferentially around a narrow band above the knurled center section (due to the coanda effect) so as to define a header that feeds the top of each vertical channel, around the circumference. The knurling itself substantially limits any circumferential oil travel, and oil bounce off. A narrow band below the knurling helps redistribute oil around the circumference, before it washes down over the bottom flange. Hence, the improved rocker arm adjusting nut outer surface is an oil guide that redirects oil droplets that impinge at transverse to upward angles, into films of oil that travel substantially axially, and downwardly to a lower collecting channel that cascades the oil around the pivot ball, underneath.

The upper collar diameter, the central body diameter, and the bottom flange diameter are maximized, but still must fit within most standard, stamped steel rocker arms, and present an axially extending heat transfer conduit for the pivot ball-rocker arm interface. In this sense, the elongated rocker arm surface acts as a symmetrical heat exchanger, cooled by oil droplets coming from a hollow push rod, and radiating heat to the inside valve cover. This mechanism removes hot spots at points of contact between the pivot ball and the interior of the rocker arm.

Further advantages and feature of the present invention will become more apparent from the following description of a preferred embodiment, wherein reference is made to the accompanying drawings.

DESCRIPTION OF THE PREFERRED EMBODIMENT

Figure 1:
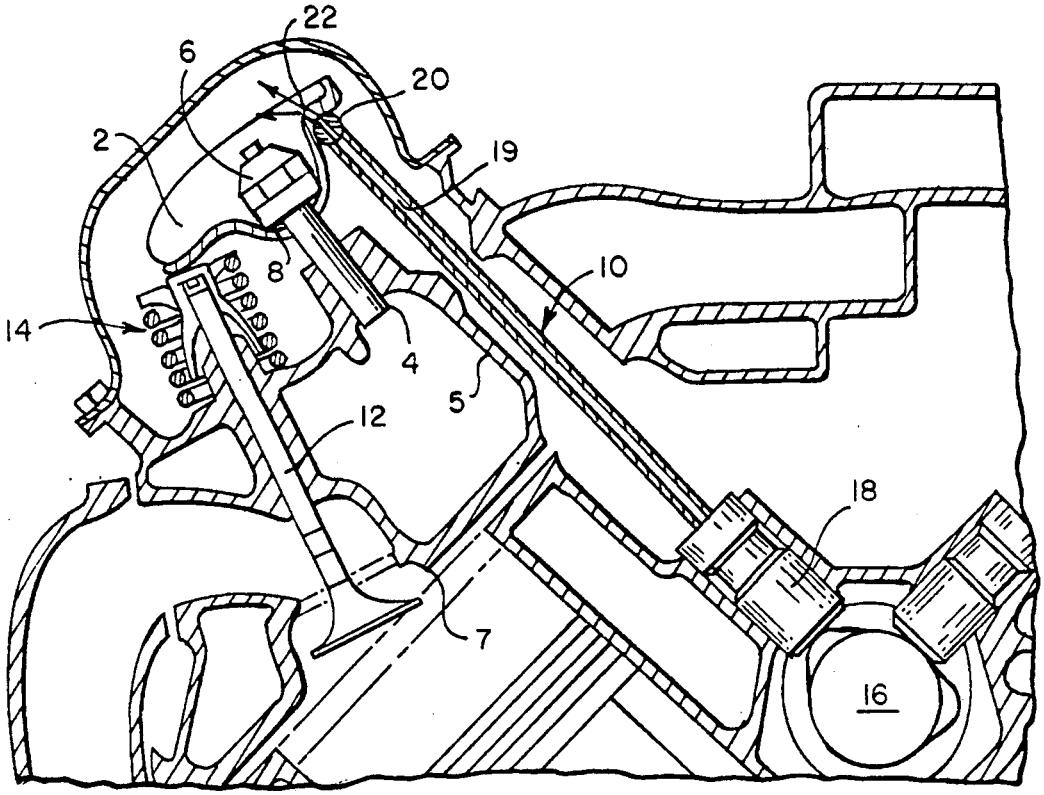
FIG. 1 (PRIOR ART)
FIG. 1 is a vertical elevation view, in partial section, showing a conventional valve train, and a conventional stamped steel rocker arm and pivot ball assembly.

FIG. 1 illustrates a prior art internal combustion engine valve train assembly, as found in many V-block engine designs having overhead valves. A stamped steel rocker arm, 2, is held in place upon a stud, 4, by a rocker arm adjusting nut, 6. The nut can be tightened axially upon the stud, which is fixed at its lower end within the cylinder head, 5. The rocker arm adjusting nut, 6, sits directly above a pivot ball, 8, which has an annular lower edge surface in frictional contact with an inner surface of the rocker arm. The rocker arm adjusting nut thereby limits the upward motion of the rocker arm, 2, in response to upward pressures exerted by both a poppet valve spring 14 and a camshaft, 16. As shown in FIG. 1, push rod 10 has pivoted the rocker arm counterclockwise around the pivot ball as a fulcrum, and caused poppet valve 12 to open away from valve seat, 7. A lobe on camshaft 16 contacts a hydraulic body lifter, 8, to cause the upward linear motion of the push rod, 10. Additionally, an oil pressure is created within the interior bore, 19, of push rod, 10. An upper push rod aperture, 20, communicates pressurized oil, in a conventional manner, into an orifice, 22, formed through the rocker arm. As shown schematically in FIG. 1, oil flows out of orifice, 22, in the form of a spray. The spray angles change significantly, due to oil pressure variations attributable to the hydraulic lifter, 18, and kinetic effects due to rocker arm speed changes. Hence, engine speed changes essentially alter the oil spray patterns issuing out of orifice, 22. It further should be apparent that a relatively short, conventional rocker arm adjusting nut, 6, does not present a significant target to such oil spray patterns, and its smooth outer surface encourages impinging oil droplets to travel rapidly around its circumference, (towards the valve spring end of the rocker), without lubricating the pivot ball, 8.

Figure 2:
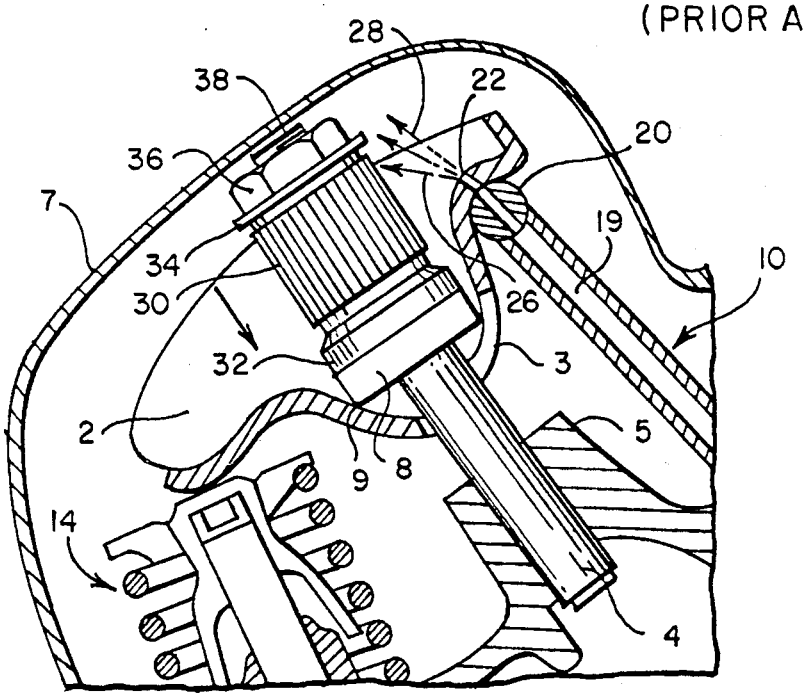
FIG. 2 is a vertical elevation detail view, in partial section, showing replacement of an improved rocker arm adjusting nut according to the present invention, within the valve train environment of FIG. 1.

With reference to FIG. 2, an improved rocker arm adjusting nut is in the same environment as the conventional rocker arm adjusting nut, 6, with all identical parts having the same numbering as in FIG. 1. Lubricating oil droplets from hollow push rod, 10, that issue out of rocker arm orifice 22, schematically are represented to follow a number of paths. For example, path 26 represents an approximate transverse angle of travel for oil issuing from orifice 22, for example, when oil pressure is relatively low because engine speed is relatively low, or when the rocker arm is in a substantially counter-clockwise point of its rotation. The oil path, 28, schematically represents an approximate upward angle of oil travel, for example when the rocker arm assembly is in a more clockwise point of its rotation, or when oil pressure and engine speed are relatively high.

Figure 3:
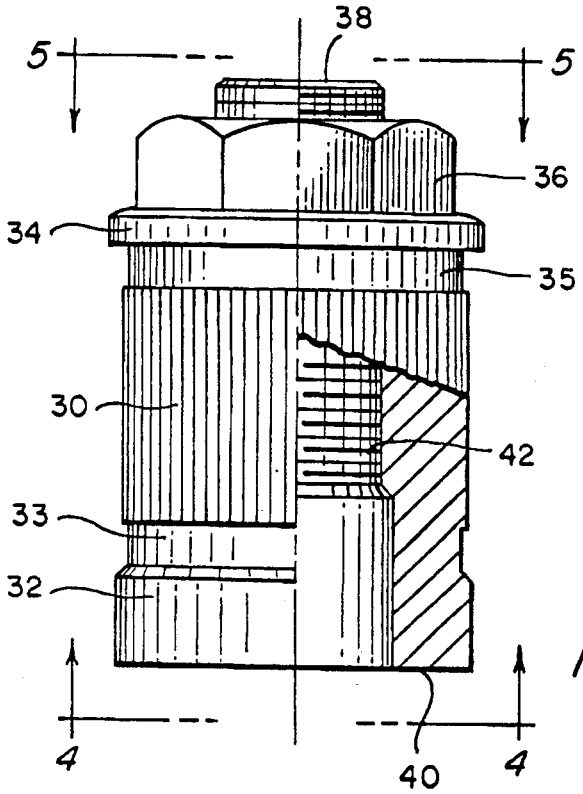
FIG. 3 is a vertical elevation view of an improved rocker arm adjusting nut according to the present invention.
Figure 4:
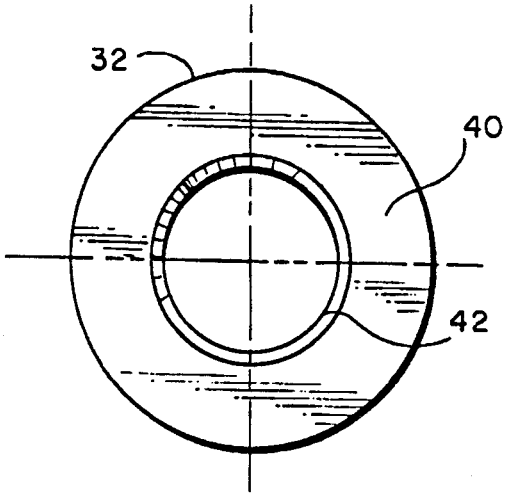
FIG. 4 is a top plan view taken along section line 4—4 of FIG. 3.
Figure 5:
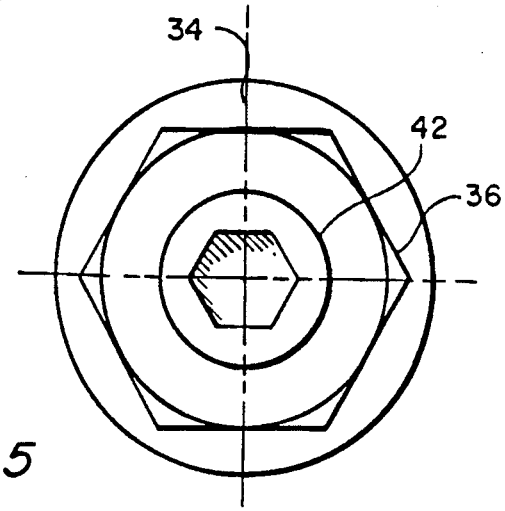
FIG. 5 is a bottom plan view taken along the line 5—5 of FIG. 3.

As shown in FIGS. 3–5, an improved rocker arm adjusting nut essentially is characterized by an axially elongated, right circular cylinder central portion, 30, that is between a bottom flange, 32, and an upper collar, 34. The central section is of a slightly less diameter than the upper collar or bottom flange, and an approximate 0.125 inch reduction in diameter is preferred. The central portion outer surface, 34, is knurled or fluted in the axial direction for approximately 0.50 inches, to define capillary channels parallel to the axis of stud, 4. A narrow lower collection channel, 33, is approximately 0.12 inches and a narrow upper collection channel, 35, is approximately 0.08 inches. The vertical knurling dampens the tendency of impinging oil droplets to bounce off, or travel around and away from the adjusting nut outer surface. Since varying oil impingement angles, as represented by paths 26–28, will occur, the axial elongation of the knurling has been found to greatly minimize overshoot and oil bounce-off. The vertical channels defined by the knurling redirect the substantially upward or transverse oil flow momentum (represented by lines 26, 28) to a substantially axial flow downward, towards the pivot ball, 8, and its rubbing interface against an inner surface of the rocker arm, 2.

By way of example, the vertical height of a conventional, stamped-steel rocker arm, in the vicinity of its central region, is approximately 1.20 inches. A preferred rocker arm adjusting nut according to the present invention when used in its intended environment will extend approximately 0.50 inches, above the top of the rocker arm. The bottom flange, 32, defines a transverse lower surface, 40, that is annular and adapted to tightly engage against a similar transverse upper surface of pivot ball, 8. The width of planar annular surface, 40, is approximately 0.20 inches. In contrast, a conventional rocker arm adjusting nut, 6, as shown in FIG. 1, has only a very narrow, annular contact ring available to provide a conduction heat transfer path out of the transverse upper surface of pivot ball, 8. In both FIGS. 1 and 2, a conventional stud, 4, and a conventional pivot ball, 8, are used, and the benefits of this invention derive solely from replacing the adjusting nut.

Hence, there is no need for replacement of stamped steel rocker arm, 22, stud, 4, or pivot ball, 8, in order to realize the advantages of the present invention. The transverse clearance between inner surfaces of a typical stamped steel rocker arm is on the order of 1.0 inches, and the axial and transverse extensions of an improved rocker arm nut, will not cause interference. As also can be appreciated by a comparison of FIG. 2 and FIG. 1, a rocker arm adjusting nut structure will extend significantly above the rocker arm itself when the present invention is used, and yet sufficient clearance exists within a conventional valve cover, 7. Further, as is apparent from FIGS. 2 and 4, the enlarged transverse bottom surface, 40, represents a significantly increased contact surface for the pivot ball, 8, to enhance heat removal from the contact areas between the inner surface of the rocker arm and the lower, annular contact surface around the bottom edge of the pivot ball element.

FIGS. 3–5 illustrate further structure details of an improved rocker arm adjusting nut, alone. A conventional allen head set screw, 38, can be accessed from the top, in order to set a positive locking of the adjusting nut against the top of a stud within thread, 42. It is conventional to tighten down a rocker arm adjusting nut to eliminate lash, after a valve train has been installed, and to use a set screw to secure that adjustment. The set screw per se is conventional, and forms no part of the present invention. As shown in FIG. 5, the dimension across the flats of a tightening nut portion, 36, may be approximately 0.622 inches; a dimension equivalent to that of the conventional nut, 6, in FIG. 1. FIGS. 3 and 4 show a pilot hole below internal thread, 42, to facilitate mounting on different style studs. Internal thread, 42, typically may be a 7/16 U.N.F. thread or a ⅜ inch U.N.F. thread. The knurled central section, 30 is spaced below upper shoulder, 34, by a circumferential channel, 35. This channel defines a header, for oil to enter the vertical capillary channels defined around the circumference, by the knurling. The base diameter, before knurling, preferably is 0.75 inch, and a straight knurl is preferred. The diameter of the upper collar, 34, provides the upper channel, 35, with an "umbrella" approximately 0.06 inches wide, so as to downwardly deflect oil droplets impinging on its lower surface. Oil droplets impinging in that region can then travel circumferentially around the channel 35, and gravity and capillary forces will tend to feed oil in the channel into the tops of the vertical knurl passages. The lower narrow channel, 33, helps to circumferentially distribute oil flowing downwardly from the channels, prior to cascading down upon pivot ball, 8.

The preferred embodiment has been found, during tests, to signficantly increase the life of rocker arms, under various operating conditions. It is believed that the construction of the preferred embodiment maintains the rocker arm pivot ball-rocker arm interface substantially cooler from the combined effects of a heat transfer away from, and increased lubrication to, that interface area. Tests reveal that between 20 and 40 degrees Fahrenheit can be removed from the steady state operating temperature of a rocker arm, simply by replacing a conventional adjusting nut with an adjusting nut according to the present invention. The nut can be made of any metal alloy, or steel, and a preferred alloy is Leadloy.

While a preferred embodiment of the invention has been shown and described, the invention is to be limited solely by the scope of the appended claims.

We claim:

1. An improved rocker arm adjusting nut intended to engage a threaded stud and position a stamped steel rocker arm and a pivot ball with respect to said stud and thereby define part of the valve train of an internal combustion engine, said adjusting nut comprising an axially elongated body with a substantially right circular cylinder central portion, a transversely overhanging upper collar spaced above said central portion, a bottom flange spaced below said central portion, a tightening nut portion spaced above said upper collar and an axial internal thread adapted to engage with an external thread on a stud, wherein said central portion has a circumferential surface that comprises axially extending passages, whereby oil droplets impinging upon said central portion circumferential surface will be urged by gravity to travel axially towards said bottom flange, when said improved rocker arm adjusting nut is used in its intended environment.

2. An improved rocker arm adjusting nut according to claim 1, wherein said central portion further comprises a narrow, circumferential upper channel between a lower surface of said upper collar and an upper surface of said axially extending passages, so as to define a header surface adapted to circumferentially feed oil droplets impinging proximate said upper collar into said vertically extending passages.

3. An improved rocker arm according to claim 2 wherein said vertical passages define capillary passages for oil, so as to direct oil droplet impinging thereon axially downward by both gravitational and capillary effects.

4. An improved rocker arm adjusting nut arm according to claim 2 wherein said bottom flange is substantially a right circular cylinder with a diameter greater than a diameter of said central portion, and a transverse lower surface that is substantially planar, and adapted for mating contact with a substantially planar upper surface on said pivot ball, when used according to its intended environment.

5. An improved rocker arm adjusting nut according to claim 2, wherein the axially elongated body is greater than one inch in axial extent, said central portion is greater than one-half inch in axial extent, and said transverse overhanging collar diameter is greater than three-quarters of an inch.

6. An improved rocker arm adjusting nut according to claim 5, wherein said central portion has a diameter of approximately three-quarters of an inch, said vertical passages comprise straight knurls cut into the circumference of said central portion, so that said vertical passages have a root diameter less than said central portion diameter and said upper channel will communicate oil into an open top of each vertical passage.

* * * * *